US012428773B2

(12) United States Patent
Park et al.

(10) Patent No.: US 12,428,773 B2
(45) Date of Patent: Sep. 30, 2025

(54) CLOTHES TREATING APPARATUS

(71) Applicant: SAMSUNG ELECTRONICS CO., LTD., Suwon-si (KR)

(72) Inventors: Junhong Park, Suwon-si (KR); Woojin Kim, Suwon-si (KR); Jinbaek Kim, Suwon-si (KR); Jihoon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 192 days.

(21) Appl. No.: 18/230,969

(22) Filed: Aug. 7, 2023

(65) Prior Publication Data

US 2024/0125039 A1 Apr. 18, 2024

Related U.S. Application Data

(63) Continuation of application No. PCT/KR2023/010108, filed on Jul. 14, 2023.

(30) Foreign Application Priority Data

Oct. 18, 2022 (KR) ..... 10-2022-0134485

(51) Int. Cl.
*D06F 58/20* (2006.01)
*D06F 25/00* (2006.01)
(Continued)

(52) U.S. Cl.
CPC ..... *D06F 58/206* (2013.01); *D06F 25/00* (2013.01); *D06F 29/005* (2013.01); *D06F 39/04* (2013.01);
(Continued)

(58) Field of Classification Search
CPC ..... D06F 25/00; D06F 29/005; D06F 39/04; D06F 39/10; D06F 58/02; D06F 58/22; D06F 58/24; D06F 58/206
See application file for complete search history.

(56) References Cited

U.S. PATENT DOCUMENTS 5,768,730 A * 6/1998 Matsumoto ..... D06F 34/16 68/23.2
7,624,466 B2 12/2009 Kim et al.
(Continued)

FOREIGN PATENT DOCUMENTS

EP 1 146 161 A1 10/2001
JP 2007-301010 11/2007
(Continued)

OTHER PUBLICATIONS

International Search Report dated Nov. 1, 2023 issued in PCT Application PCT/KR2023/010108.
(Continued)

*Primary Examiner* — Joseph L. Perrin
(74) *Attorney, Agent, or Firm* — STAAS & HALSEY LLP

(57) ABSTRACT

A clothes treating apparatus includes: a cabinet; a tub; a drum; a base forming an air flow path including an air inlet and an air outlet; a heat exchanger; a supply duct forming a first supply flow and a second supply flow path; a discharge duct forming a first discharge flow path and a second discharge flow path; a first damper configured to be movable to a first position of opening the first supply flow path and closing the second supply flow path or a second position of closing the first supply flow path and opening the second supply flow path; and a second damper configured to be movable to a third position of opening the first discharge flow path and closing the second discharge flow path or a
(Continued)

fourth position of closing the first discharge flow path and opening the second discharge flow path.

16 Claims, 13 Drawing Sheets

(51) Int. Cl.

| | |
|---|---|
| ***D06F 29/00*** | (2006.01) |
| ***D06F 39/04*** | (2006.01) |
| ***D06F 39/10*** | (2006.01) |
| ***D06F 58/02*** | (2006.01) |
| ***D06F 58/22*** | (2006.01) |
| ***D06F 58/24*** | (2006.01) |

(52) U.S. Cl.
CPC ..... *D06F 39/10* (2013.01); *D06F 58/02* (2013.01); *D06F 58/22* (2013.01); *D06F 58/24* (2013.01)

(56) References Cited

U.S. PATENT DOCUMENTS

| | | | | |
|---|---|---|---|---|
| 7,814,770 | B2 | 10/2010 | Jeon et al. | |
| 7,866,061 | B2 * | 1/2011 | Tatsumi | D06F 58/206 34/607 |
| 9,027,371 | B2 | 5/2015 | Beihoff et al. | |
| 10,619,288 | B2 * | 4/2020 | Kim | D06F 58/206 |
| 2007/0119072 | A1 | 5/2007 | Kim | |
| 2010/0146811 | A1 * | 6/2010 | Steffens | D06F 58/22 34/132 |
| 2012/0030960 | A1 * | 2/2012 | Ryoo | D06F 58/206 34/86 |
| 2014/0223758 | A1 | 8/2014 | Bison et al. | |
| 2014/0238087 | A1 * | 8/2014 | Bae | D06F 29/005 68/27 |
| 2014/0238088 | A1 * | 8/2014 | Bae | D06F 29/005 68/27 |
| 2017/0191213 | A1 * | 7/2017 | Kim | D06F 58/206 |
| 2019/0106832 | A1 * | 4/2019 | Cagliani | D06F 25/00 |
| 2022/0162795 | A1 | 5/2022 | Yeom et al. | |
| 2022/0380971 | A1 * | 12/2022 | Lee | D06F 58/10 |

FOREIGN PATENT DOCUMENTS

| | | |
|---|---|---|
| JP | 2012-312 | 1/2012 |
| KR | 10-0474328 | 3/2005 |
| KR | 10-0652459 | 12/2006 |
| KR | 10-0658842 | 12/2006 |
| KR | 10-0662364 | 1/2007 |
| KR | 10-0672501 | 1/2007 |
| KR | 10-0781244 | 12/2007 |
| KR | 10-2013-0064225 | 6/2013 |
| KR | 10-1476178 | 12/2014 |
| KR | 10-2020-0116692 | 10/2020 |
| KR | 10-2022-0069779 | 5/2022 |

OTHER PUBLICATIONS

Written Opinion dated Nov. 1, 2023 issued in PCT Application PCT/KR2023/010108.

* cited by examiner

CLOTHES TREATING APPARATUS

CROSS-REFERENCE TO RELATED APPLICATION

This application a continuation application, filed under 35 U.S.C. § 111(a), of International Application PCT/KR2023/010108 filed Jul. 14, 2023, and is based on and claims priority under 35 U.S.C. § 119 to Korean Patent Application No. 10-2022-0134485, filed on Oct. 18, 2022 in the Korean Intellectual Property Office, the disclosure of which is incorporated by reference herein in its entirety.

BACKGROUND

1. Field

The disclosure relates to a clothes treating apparatus.

2. Description of the Related Art

A washing machine is an apparatus for washing laundry by performing a washing operation, a rinsing operation, and a dehydrating operation.

Washing machines are classified into a pulsator type that washes laundry by causing water streams generated by rotations of rotating blades including small blades in the bottom of the washing tub to collide with the laundry, an agitator type that washes laundry with water streams generated by regularly changing the rotation directions of large stirring blades having blades in the center of the washing tub, and a drum type that washes laundry with impacts generated by waterfalls and detergency of a detergent by rotating the drum accommodating the laundry, according to washing types.

A dryer is an apparatus for drying laundry with hot and dry air. The dryer may include a cabinet, a heat pump device positioned inside the cabinet and including a condenser and an evaporator, a fan for generating a flow of air inside the cabinet, and a drum in which laundry is accommodated.

A clothes care apparatus includes a care room formed inside a cabinet without including a drum or a tub. The clothes care apparatus cares clothes hung on a support member being in the shape of a hanger positioned inside the care room. The clothes care apparatus may care shoes positioned inside the care room, as well as clothes.

A clothes treating apparatus may include a washing machine, a dryer, and a clothes care apparatus described above.

SUMMARY

According to an embodiment of the disclosure, a clothes treating apparatus may include: a cabinet including an air inlet and an air outlet; a tub inside the cabinet; a drum rotatable inside the tub; a base partitioning inside of the cabinet to form an air flow path including the air inlet and the air outlet, the base being positioned above the tub; a heat exchanger on the base; a supply duct forming a first supply flow path configured to guide air passed through the heat exchanger to the drum and a second supply flow path configured to guide air passed through the heat exchanger to the air outlet; a discharge duct forming a first discharge flow path configured to guide air passed through the drum to the heat exchanger and a second discharge flow path configured to guide air entered the inside of the cabinet through the air inlet to the heat exchanger; a first damper configured to be movable between a first position of opening the first supply flow path and closing the second supply flow path and a second position of closing the first supply flow path and opening the second supply flow path; and a second damper configured to be movable between a third position of opening the first discharge flow path and closing the second discharge flow path and a fourth position of closing the first discharge flow path and opening the second discharge flow path.

The clothes treating apparatus may further include a first driving motor configured to control a movement of the first damper; and a second driving motor configured to control a movement of the second damper.

The first driving motor may be configured to move the first damper to the first position or the second position, and the second driving motor may be configured to move the second damper to the third position or the fourth position.

Based on the first damper being at the first position, the second damper may be controlled to be at the third position, and based on the first damper being at the second position, the second damper may be controlled to be at the fourth position.

Based on the first damper being at the first position and the second damper being at the third position, the supply duct and the discharge duct may form a first circulation flow path of guiding air passed through the heat exchanger to the drum and guiding air passed through the drum to the heat exchanger.

Based on the first damper being at the second position and the second damper being at the fourth position, the supply duct and the discharge duct form a second circulation flow path of guiding air passed through the heat exchanger to the air outlet and guiding air entered the inside of the cabinet through the air inlet to the heat exchanger.

The supply duct may be in a front side of the base, and the discharge duct may be in a rear side of the base.

The clothes treating apparatus may further comprise a fan configured to move air, and the base may include a fan accommodating portion configured to accommodate the fan.

The fan accommodating portion may be in a front side of the base and connected to the supply duct.

The heat exchanger may include an evaporator configured to lower temperature of surrounding air; and a condenser may be configured to raise temperature of surrounding air.

The base may include a partition wall partitioning the base to form a connecting flow path of guiding air guided by the discharge duct to the supply duct, and the evaporator and the condenser may be at one side of the partition wall to be on the connecting flow path.

The clothes treating apparatus may further comprise a filter configured to filter foreign materials included in air, and the filter may be at upstream of the evaporator and the condenser on the connecting flow path and configured to filter the foreign materials included in air entering the evaporator and the condenser.

The clothes treating apparatus may further comprises a compressor on the base, and configured to compress a refrigerant, and the compressor may be at another side of the partition wall to be outside the connecting flow path.

The cabinet may be a first cabinet, the air inlet may be a first air inlet, and the air outlet may be a first air outlet, the clothes treating apparatus may further comprises a second cabinet on the first cabinet, and the second cabinet may include a second air inlet corresponding to the first air outlet and a second air outlet corresponding to the first air inlet.

Based on inside of the drum of the first cabinet being dried, the first damper may be at the first position and the second damper may be at the third position, and based on inside of the second cabinet being dried, the first damper may be at the second position and the second damper may be at the fourth position.

A washing operation of the first cabinet and a drying operation of the second cabinet may be performed simultaneously.

A clothes treating apparatus according to an embodiment of the disclosure includes: a cabinet, wherein an air inlet and an air outlet are formed in an upper side of the cabinet; a tub positioned inside the cabinet; a drum rotatably provided inside the tub; a base positioned above the tub and partitioning inside of the cabinet; a heat exchanger positioned on the base; a supply duct forming a first supply flow path configured to guide air passed through the heat exchanger to the drum and a second supply flow path configured to guide air passed through the heat exchanger to the air outlet; a discharge duct forming a first discharge flow path configured to guide air passed through the drum to the heat exchanger and a second discharge flow path configured to guide air entered the inside of the cabinet through the air inlet to the heat exchanger; a first damper configured to be movable between a first position of opening the first supply flow path and closing the second supply flow path and a second position of closing the first supply flow path and opening the second supply flow path; and a second damper configured to be movable between a third position of opening the first discharge flow path and closing the second discharge flow path and a fourth position of closing the first discharge flow path and opening the second discharge flow path.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
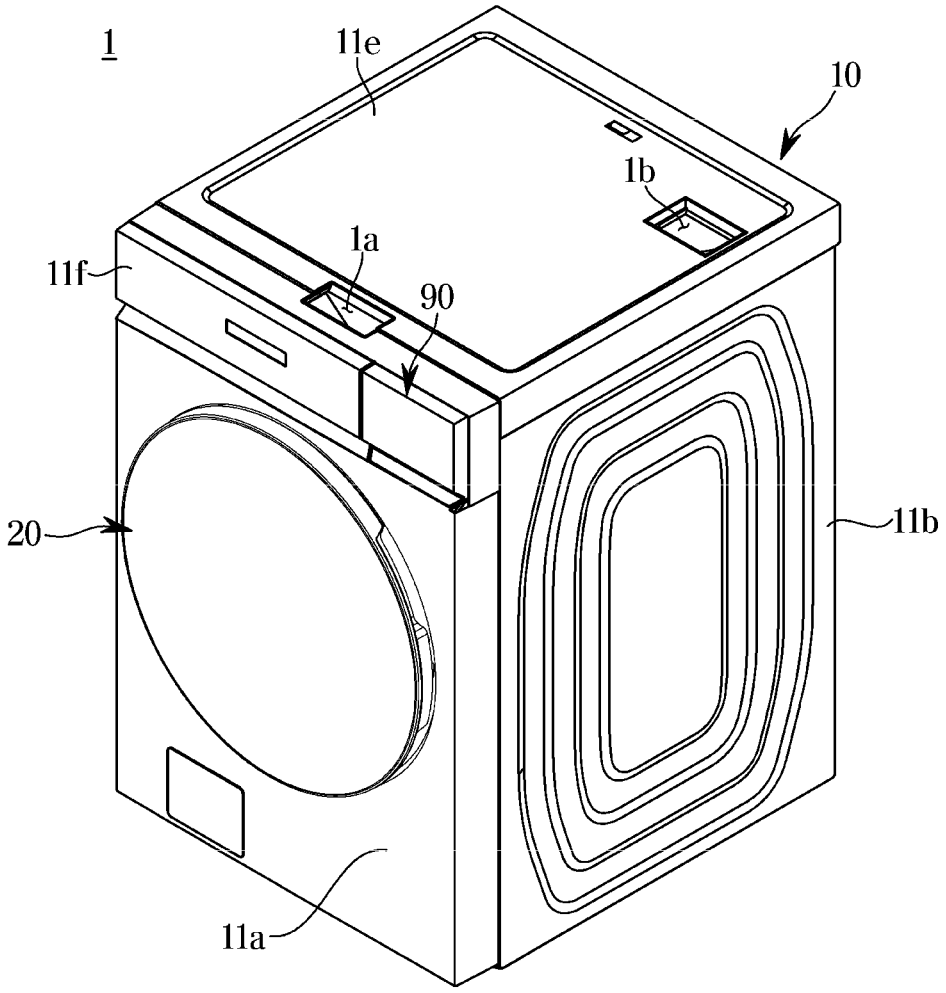
FIG. 1 is a perspective view of a clothes treating apparatus according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Meanwhile, in the following description, the terms "front", "rear", "left", "right", "upper", "lower", etc. are defined based on the drawings, and the shapes and positions of the components are not limited by the terms.

Therefore, it is an aspect of the disclosure to provide a clothes treating apparatus capable of washing clothes put in a drum and drying clothes inside the drum by using a heat pump.

It is an aspect of the disclosure to provide a clothes treating apparatus capable of controlling a flow path of a circulating airflow passing through a heat exchanger of a heat pump.

It is an aspect of the disclosure to provide a clothes treating apparatus capable of converting a flow path to circulate an airflow passing through a heat exchanger of a heat pump inside a cabinet or to circulate the airflow inside another cabinet positioned on the cabinet.

Additional aspects of the disclosure will be set forth in part in the description which follows and, in part, will be obvious from the description, or may be learned by practice of the disclosure.

Hereinafter, an embodiment of the disclosure will be described in detail with reference to the accompanying drawings.

Figure 2:
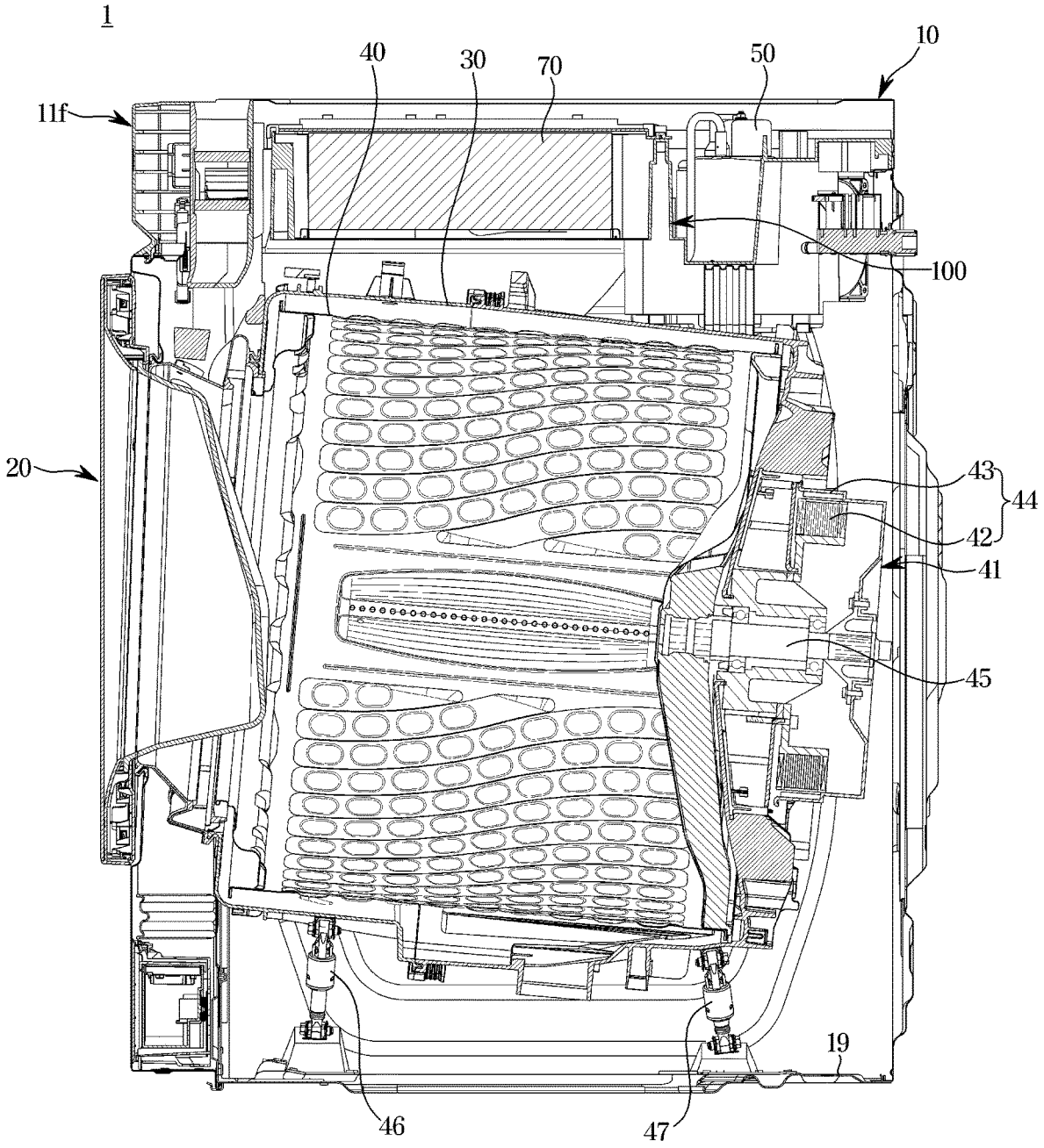
FIG. 2 is a schematic cross-sectional view of a clothes treating apparatus according to an embodiment of the disclosure.

FIG. 1 is a perspective view of a clothes treating apparatus according to an embodiment of the disclosure. FIG. 2 is a schematic cross-sectional view of a clothes treating apparatus according to an embodiment of the disclosure.

Referring to FIGS. 1 and 2, a clothes treating apparatus 1 according to an embodiment of the disclosure may include a cabinet 10 forming an appearance and accommodating various components therein, a tub 30 provided inside the cabinet 10 to store mixed water as a mixture of water and a detergent, a drum 40 provided inside the tub 30, accommodating laundry, and configured to rotate, a driver 41 for rotating the drum 40, and a detergent supply device 90 for supplying a detergent to the tub 30. The clothes treating apparatus 1 may wash laundry accommodated inside the drum 40 by including the above-described components.

The clothes treating apparatus 1 according to an embodiment of the disclosure may include heat pumps 50, 60, and 70. The heat pumps 50, 60, and 70 may be provided in an upper machine room inside the cabinet 10. The upper machine room may be a space above a base 100 inside the cabinet 10. The clothes treating apparatus 1 may dry laundry accommodated inside the drum 40 by including the heat pumps 50, 60, and 70.

The clothes treating apparatus 1 may be a washing machine capable of performing washing and drying independently. More specifically, the clothes treating apparatus 1 may be a washing machine capable of drying laundry by using the heat pumps 50, 60, and 70, although not limited thereto. However, the clothes treating apparatus 1 may include a dryer including a heat pump.

The cabinet 10 may be substantially in a shape of a hexahedron. The cabinet 10 may be in a shape of a box of which a front side opens. The cabinet 10 may include a front panel 11*a* forming the open, front side, side plates 11*b* and 11*c* forming both sides extending toward a rear direction of the front panel 11*a*, and a rear plate 11*d* forming a rear side of the cabinet 10. According to an embodiment of the disclosure, the rear plate 11*d* and the side plates 11*b* and 11*c* of the cabinet 10 may be integrated into one body, although not limited thereto. However, the rear plate 11*d* and the side plates 11*b* and 11*c* may be provided separately and then coupled to each other. The cabinet 10 may include a bottom plate 19 forming a bottom and a top cover 11*e* forming a top.

In the front panel 11*a*, an opening (not shown) to enable a user to put laundry into the drum 40 may be formed. In the tub 30 and the drum 40, openings through which laundry is put into or withdrawn from the tub 30 and the drum 40 may be formed, and the openings of the tub 30 and the drum 40 may be positioned to correspond to the opening of the front panel 11*a*.

An upper front panel 11*f* and the detergent supply device 90 may be provided above the front panel 11*a*.

The base 100 may be provided inside the cabinet 10. The base 100 may partition an inside space of the cabinet 10 into an upper space and a lower space. The base 100 may be provided above the tub 30. The upper front panel 11*f* may cover a front surface of the base 100.

The cabinet 10 may include a first air outlet 1*a* and a first air inlet 1*b* formed in an upper side. The first air outlet 1*a* and the first air inlet 1*b* may be formed in the top cover 11*e*. Air passed through heat exchangers 60 and 70 of the heat pumps 50, 60, and 70 which will be described below may be discharged to outside of the cabinet 10 through the first air outlet 1*a*, and outside air of the cabinet 10 may enter inside of the cabinet 10 through the first air inlet 1*b*. Air entered the inside of the cabinet 10 through the first air inlet 1*b* may be discharged to the first air outlet 1*a* via the heat exchangers 60 and 70 of the heat pumps 50, 60, and 70. Such a flow of air will be described below.

A door 20 may open or close the opening provided in the front panel 11*a*. The door 20 may be rotatably coupled to the cabinet 10 by a hinge member (not shown).

The base 100 may be provided above the tub 30. The base 100 may partition the inside of the cabinet 10 into the upper space and the lower space. The heat pumps 50, 60, and 70 may be provided on the base 100.

The base 100 may partition the inside of the cabinet 10 to form an air flow path including the first air outlet 1*a* and the first air inlet 1*b*.

The detergent supply device 90 may be positioned above the front panel 11*a*. The detergent supply device 90 may be taken out in a front direction of the cabinet 10. The detergent supply device 90 may be taken out in the front direction from the cabinet 10 and separated from the cabinet 10.

The driver 41 may be provided behind the drum 41. The driver 41 may be a component for rotating the drum 40, and rotate the drum 40 by transferring a driving force generated in a driving motor 44 to a rotating shaft 45.

The driving motor 44 may be configured with a fixed stator 42, and a rotor 43 that rotates by electromagnetically interacting with the stator 42 to convert an electric force to a mechanical rotational force.

The tub 30 may store mixed water as a mixture of water and a detergent. The tub 30 may be substantially in a shape of a cylinder. The tub 30 may be fixed inside the cabinet 10.

The drum 40 may wash laundry by raising and dropping the laundry while rotating inside the tub 30. A plurality of lifters (not shown) may be provided inside the drum 40.

Below the tub 30, a drain device (not shown) including a drain pipe (not shown) for draining inside water of the tub 30, a drain valve (not shown), etc. may be installed.

The tub 30 may be elastically supported by an upper spring (not shown) and lower dampers 46 and 47 inside the cabinet 10. The spring and the dampers 46 and 47 may absorb vibration energy between the tub 30 and the cabinet 10 upon transferring of vibrations generated according to rotations of the drum 40 to the tub 30 and the cabinet 10 to attenuate the vibrations.

Figure 3:
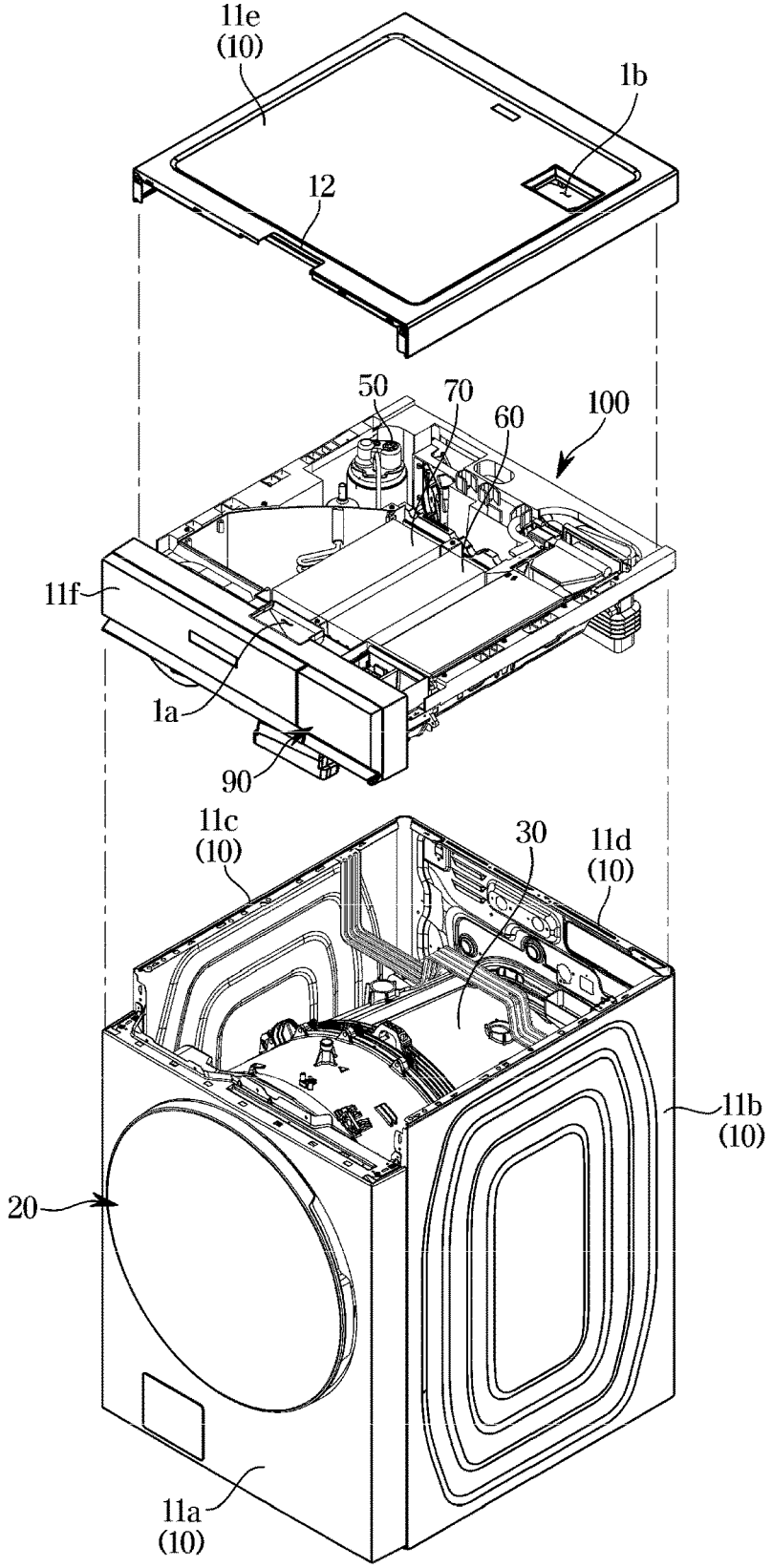
FIG. 3 is an exploded view of some components in a clothes treating apparatus according to an embodiment of the disclosure.

FIG. 3 is an exploded view of some components in a clothes treating apparatus according to an embodiment of the disclosure.

Referring to FIG. 3, the clothes treating apparatus 1 according to an embodiment of the disclosure may include the upper machine room provided inside the cabinet 10. The upper machine room may be a space between the base 100 and the top cover 11*e* inside the cabinet 10.

The base 100 may be provided above the tub 30. The base 100 may partition the inside of the cabinet 10 into the upper space and the lower space.

The base 100 may support the heat pumps 50, 60, and 70. The heat pumps 50, 60, and 70 may be mounted on the base 100. The upper front panel 11*f* may be coupled to the front surface of the base 100. The upper front panel 11*f* may cover a portion of the front surface of the base 100.

The top cover 11*e* may include a recess 12 formed by causing a portion of a front end of the top cover 11*e* to recede in the rear direction, the recess 12 forming the first air outlet 1*a*.

Figure 4:
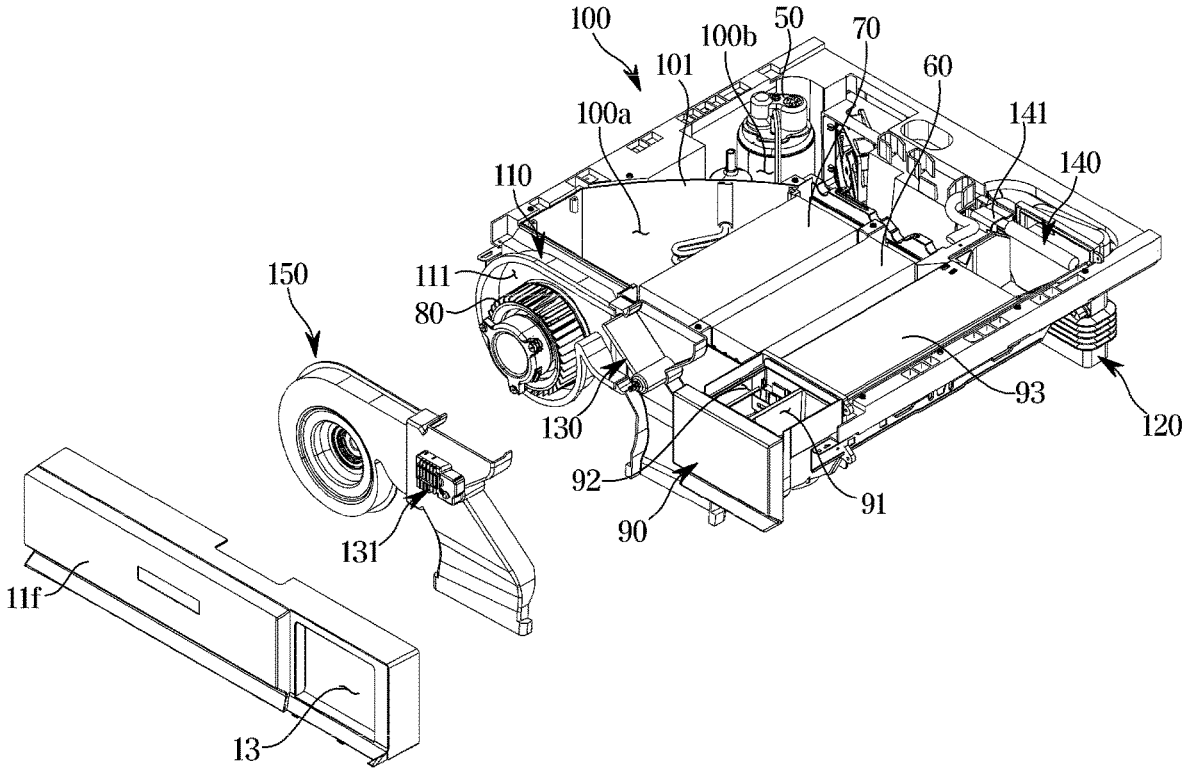
FIG. 4 shows an upper machine room in a front direction in a clothes treating apparatus according to an embodiment of the disclosure.

FIG. 4 shows an upper machine room in a front direction in a clothes treating apparatus according to an embodiment of the disclosure.

Referring to FIG. 4, the heat pumps 50, 60, and 70 may be positioned on the base 100. More specifically, a compressor 50 for compressing a refrigerant, an evaporator 60 for lowering temperature of surrounding air, and a condenser 70 for raising temperature of surrounding air may be respectively positioned on the base 100. The evaporator 60 and the condenser 70 may be arranged side by side. In other words, one side surface of the evaporator 60 may face one side surface of the condenser 70.

The evaporator 60 and the condenser 70 may be positioned to one side 100*a* of a partition wall 101 partitioning the base 100. The compressor 50 may be positioned to another side 100*b* of the partition wall 101. The evaporator 60 and the condenser 70 may be spatially separated from the compressor 50 by the partition wall 101 on the base 100. The one side 100*a* of the partition wall 101, to which the evaporator 60 and the condenser 70 are positioned, may be referred to as a connecting flow path 100*a*.

The evaporator 60 and the condenser 70 may perform heat-exchange with air passing through the connecting flow path 100*a* to lower humidity of the air. High-temperature, low-humidity air passed through the evaporator 60 and the condenser 70 may become low-temperature, high-humidity air by passing through the inside of the drum 40 or inside of a second cabinet 2 which will be described below. The low-temperature, high-humidity air passed through the inside of the drum 40 and the inside of the second cabinet 2 and then again entered the evaporator 60 and the condenser 70 may become high-temperature, low-humidity air by passing through the evaporator 60 and the condenser 70. Through this process, the clothes treating apparatus 1 may dry clothes accommodated inside the drum 40 or the second cabinet 2.

The compressor 50 may be positioned outside the connecting flow path 100*a* by the partition wall 101. By positioning the compressor 50 outside the connecting flow path 100*a*, it may be possible to prevent temperature of air passing through the connecting flow path 100*a* from rising unnecessarily. Also, by limiting the connecting flow path 100*a* to some area on the base 100 through the partition wall 101, an area of the connecting flow path 100*a* for guiding air to the heat exchangers 60 and 70 may be reduced, and accordingly, a flow of air on the connecting flow path 100*a* may be facilitated.

In a front side of the base 100, supply ducts 110 and 150 forming a first supply flow path for guiding air passed through the heat exchangers 60 and 70 to the drum 40 and a second supply flow path for guiding air passed through the heat exchangers 60 and 70 to the first air outlet 1*a* may be provided.

The supply ducts 110 and 150 may be provided in the front side of the base 100. The supply ducts 110 and 150 may include a first supply duct 110 provided in the front end of the base 100, and a second supply duct 150 coupled to the first supply duct 110 and forming the first supply flow path and the second supply flow path.

The supply ducts 110 and 150 may form a fan accommodating portion 111 that accommodates a fan 80 for moving air. The fan accommodating portion 111 may be connected to the first supply flow path and the second supply flow path. The first supply flow path may extend downward from the fan accommodating portion 111, and the second supply flow path may extend upward from the fan accommodating portion 111.

A first damper 130 may be provided inside the supply ducts 110 and 150. The first damper 130 may be movable between a first position (see FIG. 9) of opening the first supply flow path and closing the second supply flow path and a second position (see FIG. 12) of closing the first supply flow path and opening the second supply flow path. A first driving motor 131 for moving the first damper 130 between the first position and the second position may be coupled to the second supply duct 150. A driving shaft (not shown) of the second driving motor 131 may penetrate the second supply duct 150 and be coupled to the first damper 130. Unlike this, the first driving motor 131 may be positioned inside the supply ducts 110 and 150.

A discharge duct 120 may be provided in a rear side of the base 100. The discharge duct 120 may form a first discharge flow path for guiding air passed through the drum 40 to the heat exchangers 60 and 70, and a second discharge flow path for guiding air entered the inside of the cabinet 10 through the first air inlet 1*b* to the heat exchangers 60 and 70. A second damper 140 for opening or closing the first discharge flow path and the second discharge flow path, and a second driving motor 141 for moving the second damper 140 may be provided in the rear side of the base 100. The second damper 140, the discharge duct 120, and the first and second discharge flow paths will be described below.

The detergent supply device 90 may be detachably coupled to the base 100. The detergent supply device 90 may be inserted in the base 100, or taken out of the base 100 by moving from the base 100 in the front direction. The detergent supply device 90 may include a first detergent accommodating portion 91 and a second detergent accommodating portion 92. The first detergent accommodating portion 91 and the second detergent accommodating portion 92 may be arranged side by side. A detergent may be put in one of the first detergent accommodating portion 91 and the second detergent accommodating portion 92, and a fabric softener may be put in the remaining one.

The detergent supply device 90 may include a filter accommodating portion 93. The filter accommodating portion 93 may be positioned on the connecting flow path 100*a*. The filter accommodating portion 93 may accommodate filters 95*a* and 95*b* which will be described below. Because the filter accommodating portion 93 is positioned on the connecting flow path 100*a*, the filters 95*a* and 95*b* may be positioned on the connecting flow path 100*a*. The filters 95*a* and 95*b* may filter foreign materials included in air entered the filter accommodating portion 93.

The upper front panel 11*f* may include a panel opening 13. The detergent accommodating portions 91 and 92 of the detergent supply device 90 and the filter accommodating portion 93 may be taken out in the front direction of the upper front panel 11*f* through the panel opening 13. The upper front panel 11*f* may be coupled to the front surface of the base 100. The second supply duct 150 may be positioned between the upper front panel 11*f* and the first supply duct 110.

Figure 5:
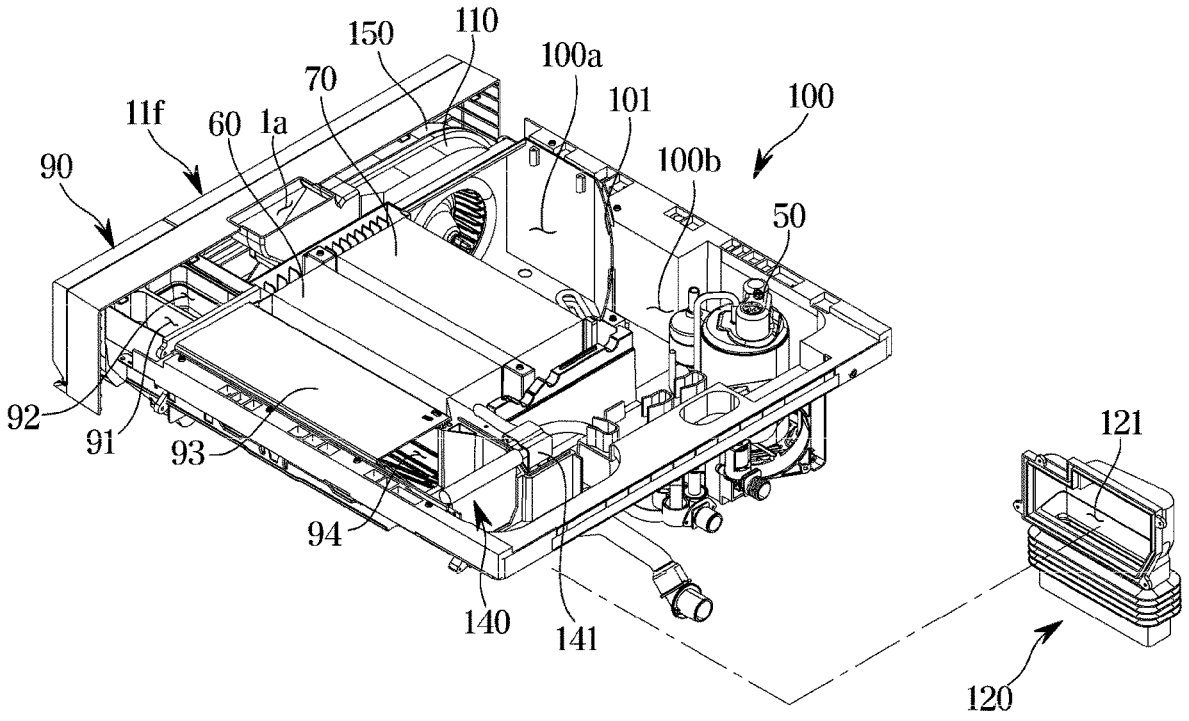
FIG. 5 shows an upper machine room in a rear direction in a clothes treating apparatus according to an embodiment of the disclosure.

FIG. 5 shows an upper machine room in a rear direction in a clothes treating apparatus according to an embodiment of the disclosure.

Referring to FIG. 5, the discharge duct 120 may be coupled to the base 100. The discharge duct 120 may be coupled to the base 100 to form the first discharge flow path and the second discharge flow path together with the base 100.

The second damper 140 may be positioned at an intersection of the first discharge flow path and the second discharge flow path. The second damper 140 may be movable between a third position (see FIG. 10) of opening the first discharge flow path and closing the second discharge flow path and a fourth position (see FIG. 13) of closing the first discharge flow path and opening the second discharge flow path. The second driving motor 141 may provide a driving force to move the second damper 140 between the third position and the fourth position.

The discharge duct 120 may include a duct outlet 121 that faces the second damper 140 located at the fourth position. Air entered through a duct inlet 122 (see FIG. 10) may be discharged through the duct outlet 121.

The detergent supply device 90 may include a filter inlet 94 formed in a rear portion of the filter accommodating portion 93. Air entered the filter inlet 94 may pass through the filters 95*a* and 95*b* and be guided to the heat exchangers 60 and 70.

Figure 6:
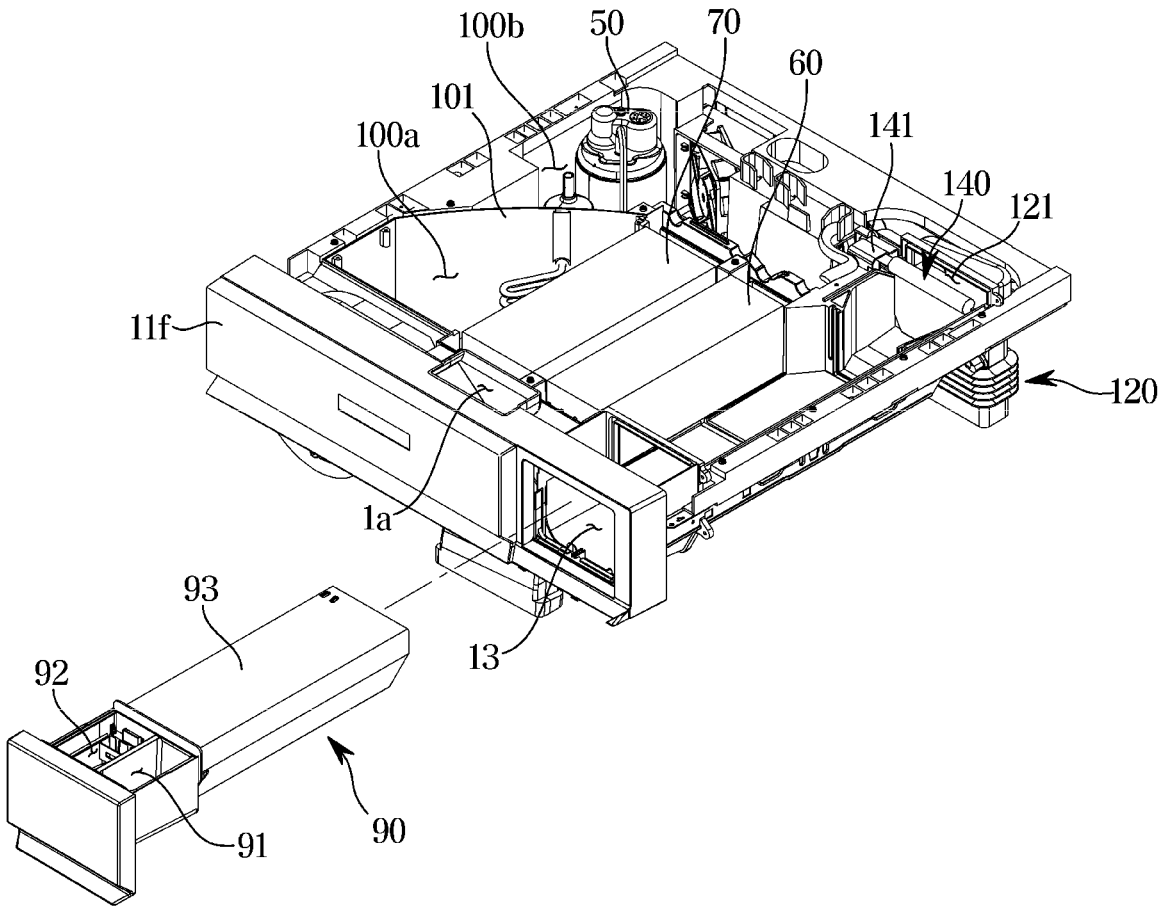
FIG. 6 shows a state in which a detergent supply device is separated from an upper machine room, in a clothes treating apparatus according to an embodiment of the disclosure.

FIG. 6 shows a state in which a detergent supply device is separated from an upper machine room, in a clothes treating apparatus according to an embodiment of the disclosure.

Referring to FIG. 6, the detergent supply device 90 may be taken out in the front direction of the base 100 and separated from the base 100 or the cabinet 10. After the detergent supply device 90 is separated from the base 100 or the cabinet 10, the filters 95*a* and 95*b* coupled to the filter accommodating portion 93 may be replaced or washed.

Figure 7:
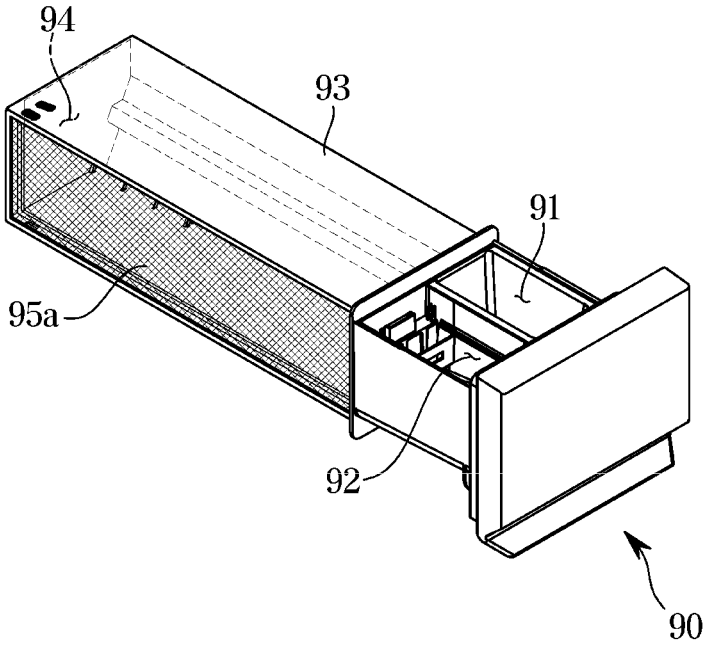
FIG. 7 shows a detergent supply device separately in a clothes treating apparatus according to an embodiment of the disclosure.

FIG. 7 shows a detergent supply device separately in a clothes treating apparatus according to an embodiment of the disclosure.

Referring to FIG. 7, the filter 95*a* may be coupled to the filter accommodating portion 93 to cover one side of the filter accommodating portion 93. Air entered the filter inlet 94 may pass through the filter 95*a* covering one side of the filter accommodating portion 93 and be guided to the heat exchangers 60 and 70.

Figure 8:
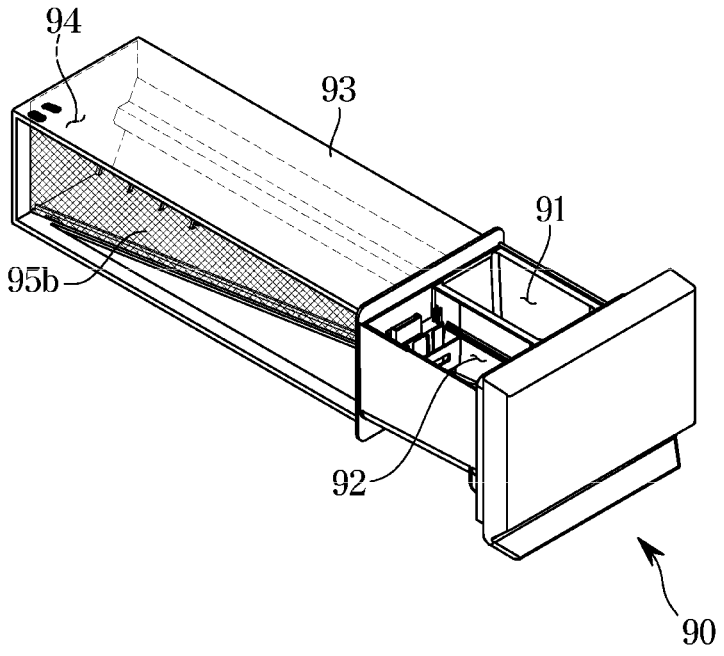
FIG. 8 shows a detergent supply device separately in a clothes treating apparatus according to an embodiment of the disclosure.

FIG. 8 shows a detergent supply device separately in a clothes treating apparatus according to an embodiment of the disclosure.

Referring to FIG. 8, the filter 95*b* may be coupled to the filter accommodating portion 93 in such a way as to cross the filter accommodating portion 93 in a diagonal direction. Like the filter 95*a* shown in FIG. 7, air entered the filter inlet 94 may pass through the filter 95*a* positioned to cross the filter accommodating portion 93 and be guided to the heat exchangers 60 and 70.

The filters 95*a* and 95*b* shown in FIGS. 7 and 8 may be positioned at upstream of the evaporator 60 and the condenser 70 on the connecting flow path 100*a* to filter foreign materials included in air entering the evaporator 60 and the condenser 70. In other words, air moving along the connecting flow path 100*a* may pass through the filters 95*a* and 95*b* and then be guided to the evaporator 60 and the condenser 70.

Figure 9:
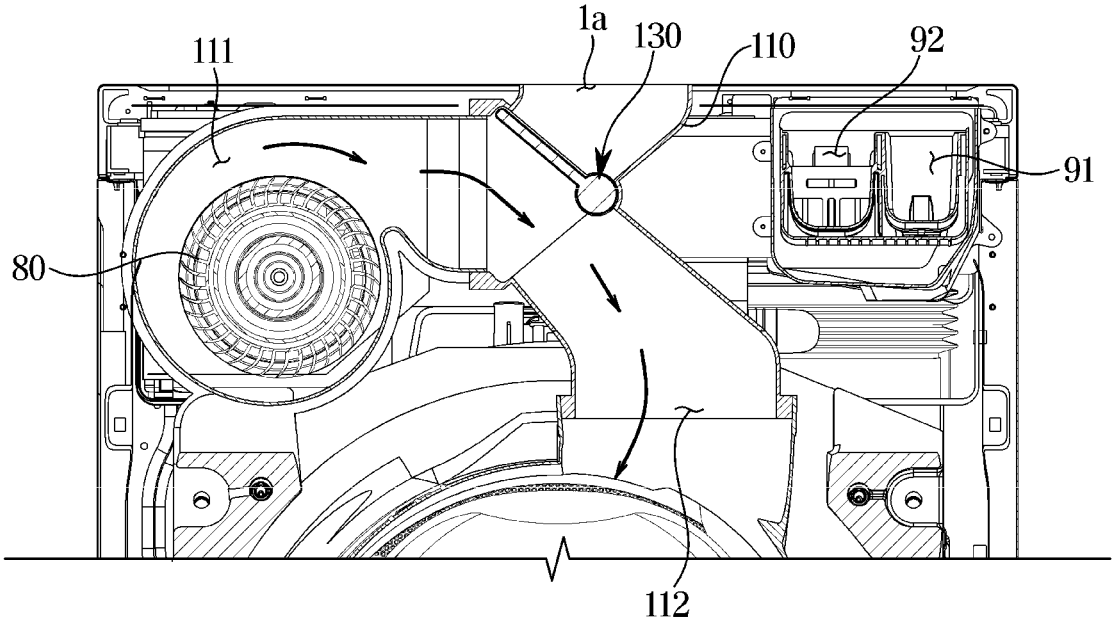
FIG. 9 is a cross-sectional view of a clothes treating apparatus according to an embodiment of the disclosure, seen in a front direction, while a first damper is located at a first position.

FIG. 9 is a cross-sectional view of a clothes treating apparatus according to an embodiment of the disclosure, seen in a front direction, while a first damper is located at a first position.

The first supply flow path will be described with reference to FIG. 9.

FIG. 9 shows a flow of air moving along the first supply flow path while the first damper 130 is located at the first position. While the first damper 130 is located at the first position, air flowing by the fan 80 may be guided to the drum 40 along the first supply flow path. The first damper 130 may be positioned at an intersection of the first supply flow path and the second supply flow path. While the first damper 130 is located at the first position, the second supply flow path may be closed, and the first supply flow path may be opened. By this arrangement, air flowing by the fan 80 may move downward along the first supply flow path, and then pass through an outlet 112 of the supply ducts 110 and 150 to move to the inside of the drum 40.

Figure 10:
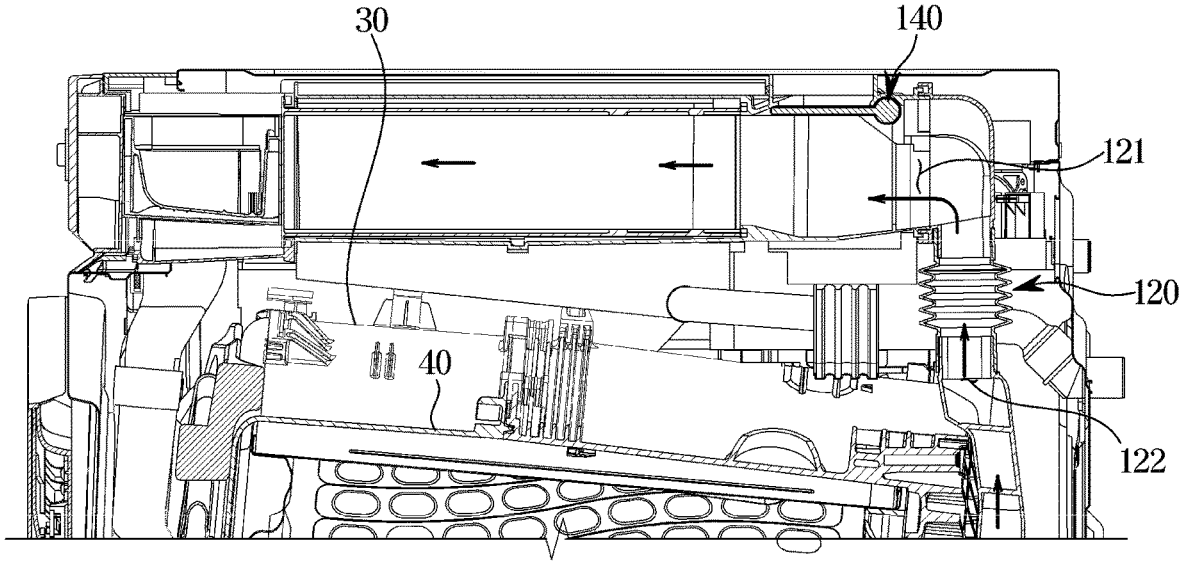
FIG. 10 is a side cross-sectional view of a clothes treating apparatus according to an embodiment of the disclosure, while a second damper is located at a third position.

FIG. 10 is a side cross-sectional view of a clothes treating apparatus according to an embodiment of the disclosure while a second damper is located at a third position.

The first discharge flow path will be described with reference to FIG. 10.

FIG. 10 shows a flow of air moving along the first discharge flow path while the second damper 140 is located at the third position. While the second damper 140 is located at the third position, air passed through the drum 40 may enter the inside of the discharge duct 120 through an opening (not shown) formed in a rear portion of the drum 40. Air entered the duct inlet 122 of the discharge duct 120 may pass through the discharge duct 120 and be discharged through the duct outlet 121. While the second damper 140 is located at the third position, air passed through the duct outlet 121 may move in the front direction of the base 100 along the connecting flow path 100*a* and then move to the heat exchangers 60 and 70 via the filters 95*a* and 95*b*.

Referring to FIGS. 9 and 10, while the first damper 130 is located at the first position and the second damper 140 is located at the third position, the supply ducts 110 and 150 and the discharge duct 120 may form a first circulation flow path of guiding air passed through the heat exchangers 60 and 70 to the inside of the drum 40 and again guiding air passed through the drum 40 to the heat exchangers 60 and 70. In other words, while the first damper 130 is located at the first position and the second damper 140 is located at the third position, the first circulation flow path of circulating the heat exchangers 60 and 70 and the drum 40 may be formed.

Figure 11:
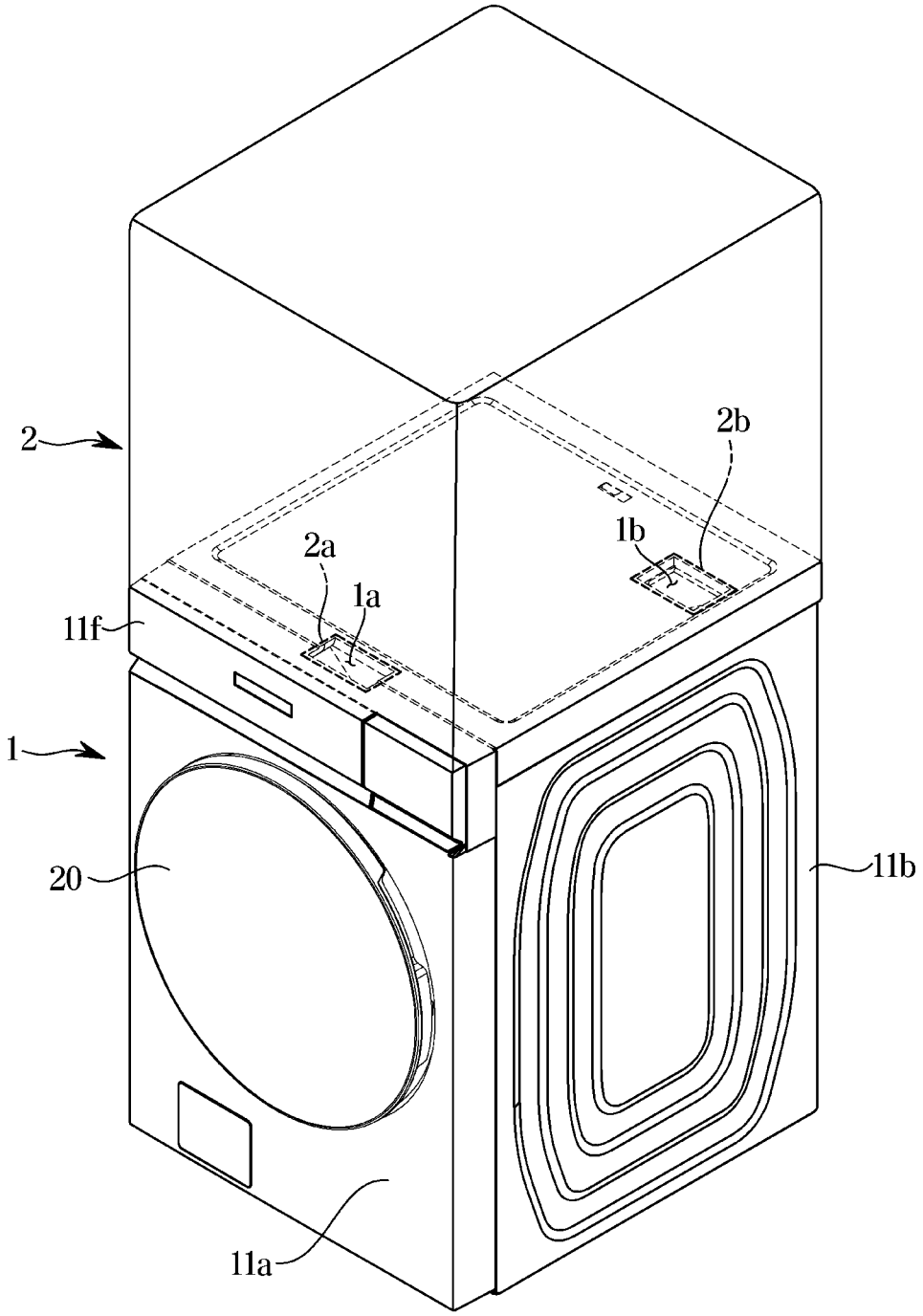
FIG. 11 is a perspective view of a clothes treating apparatus according to an embodiment of the disclosure.

FIG. 11 is a perspective view of a clothes treating apparatus according to an embodiment of the disclosure.

Referring to FIG. 11, the second cabinet 2 may be positioned on the clothes treating apparatus 1 according to an embodiment of the disclosure. The second cabinet 2 may be one of cabinets of a dryer and a clothes care apparatus, although not limited thereto. However, the second cabinet 2 may be one of cabinets of various apparatuses including a dry room for drying clothes.

The second cabinet 2 may include a second air inlet 2*a* and a second air outlet 2*b* formed in a lower portion. Air may enter inside of the second cabinet 2 through the second air inlet 2*a*. Inside air of the second cabinet 2 may be discharged to outside of the second cabinet 2 through the second air outlet 2*b*. The second air inlet 2*a* may be formed at a location corresponding to the first air outlet 1*a* of the cabinet 10. The second air outlet 2*b* may be formed at a location corresponding to the first air inlet 1*b* of the cabinet 10.

Figure 12:
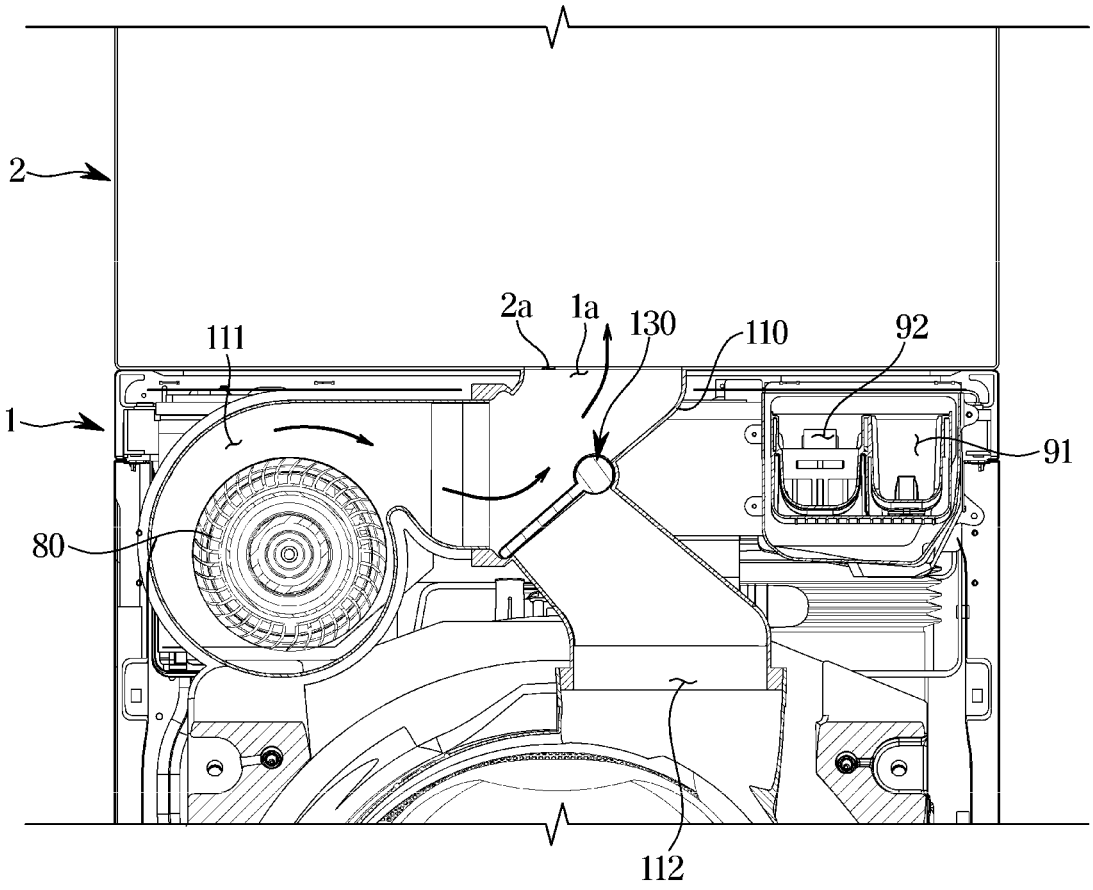
FIG. 12 is a cross-sectional view of a clothes treating apparatus according to an embodiment of the disclosure, seen in a front direction, while a first damper is located at a second position.

FIG. 12 is a cross-sectional view of a clothes treating apparatus according to an embodiment of the disclosure, seen in a front direction, while a first damper is located at a second position.

The second supply flow path will be described with reference to FIG. 12.

FIG. 12 shows a flow of air moving along the second supply flow path, while the first damper 130 is located at the second position. While the first damper 130 is located at the second position, air flowing by the fan 80 may be guided to the first air outlet 1*a* through the second supply flow path. Air guided to the first air outlet 1*a* may move to the inside of the second cabinet 2 by passing through the first air outlet 1*a* and the second air inlet 2*a*.

The first damper 130 may be located at an intersection of the first supply flow path and the second supply flow path. While the first damper 130 is located at the second position, the first supply flow path may be closed, and the second supply flow path may be opened. By this arrangement, air flowing by the fan 80 may move upward along the second supply flow path, and move to the second cabinet 2 by passing through the first air outlet 1*a* and the second air inlet 2*a*.

Figure 13:
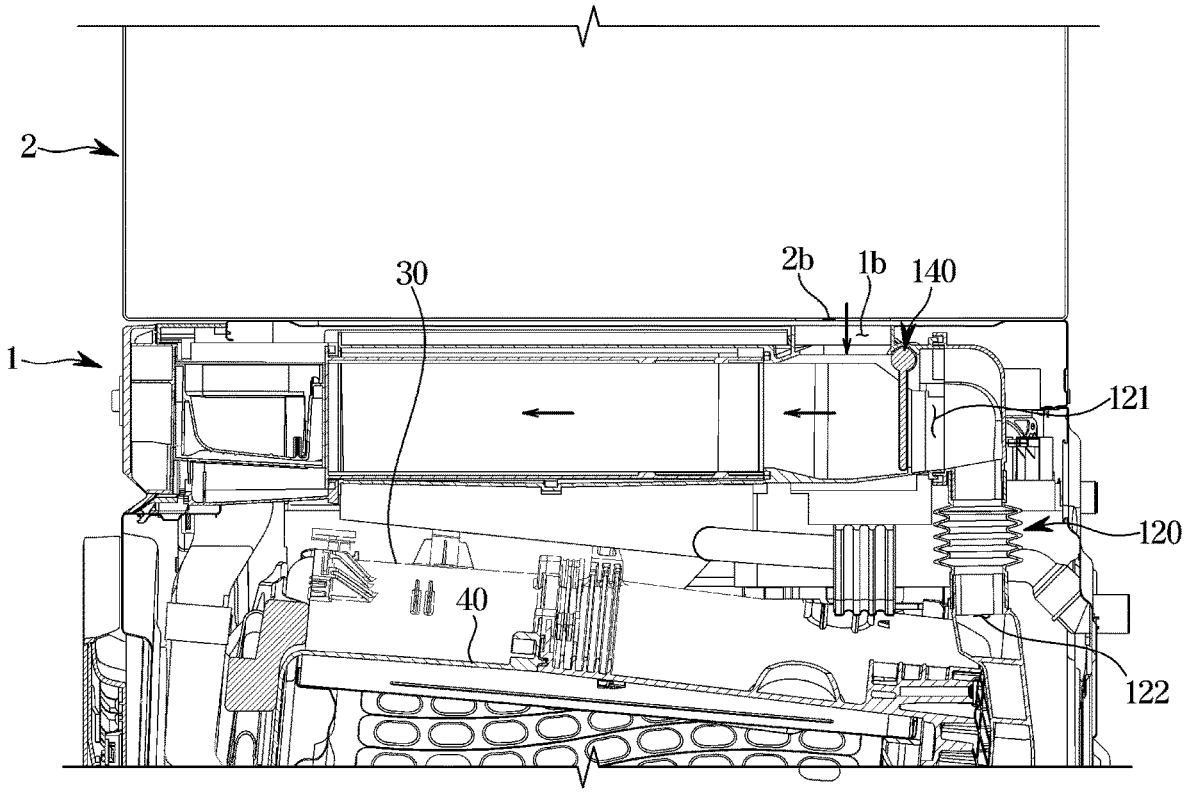
FIG. 13 is a side cross-sectional view of a clothes treating apparatus according to an embodiment of the disclosure, while a second damper is located at a third position.

FIG. 13 is a side cross-sectional view of a clothes treating apparatus according to an embodiment of the disclosure, while a second damper is located at a third position.

The second discharge flow path will be described with reference to FIG. 13.

FIG. 13 shows a flow of air moving along the second discharge flow path while the second damper 140 is located at the fourth position. While the second damper 140 is located at the fourth position, inside air of the second cabinet 2 may enter the inside of the cabinet 10 by passing through the second air outlet 2*b* of the second cabinet 2 and the first air inlet 1*b*. Air entered the inside of the cabinet 10 through the first air inlet 1*b* may be guided to the heat exchangers 60 and 70 along the connecting flow path 100*a*. Air entered the connecting flow path 100*a* through the first air inlet 1*b* may be guided to the heat exchangers 60 and 70 via the filters 95*a* and 95*b*.

While the second damper 140 is located at the fourth position, the second damper 140 may cover the duct outlet 121 of the discharge duct 120. Accordingly, air entered the inside of the cabinet 10 from the second cabinet 2 may be prevented from moving to the inside of the discharge duct 120 by passing through the duct outlet 121. Also, inside air of the drum 40 may be prevented from entering the heat exchangers 60 and 70 by passing through the discharge duct 120 and the duct outlet 121.

Referring to FIGS. 12 and 13, while the first damper 130 is located at the second position and the second damper 140 is located at the fourth position, the supply ducts 110 and 150 and the discharge duct 120 may form a second circulation flow path of guiding air passed through the heat exchangers 60 and 70 to the inside of the second cabinet 2 and guiding air passed through the inside of the second cabinet 2 to the heat exchangers 60 and 70. In other words, while the first damper 130 is located at the second position and the second damper 140 is located at the fourth position, a second circulation flow path of circulating the heat exchangers 60 and 70 and the inside of the second cabinet 2 may be formed.

According to an embodiment of the disclosure, a washing operation of the clothes treating apparatus 1 and a drying operation of the second cabinet 2 may be performed simultaneously. More specifically, the clothes treating apparatus 1 may wash laundry put in the drum 40 regardless of operations of the heat pumps 50, 60, and 70, and simultaneously dry clothes accommodated in the second cabinet 2 by operating the heat pumps 50, 60, and 70 and the fan 80.

According to an aspect of the disclosure, a clothes treating apparatus capable of washing clothes put in a drum and drying clothes inside the drum by using a heat pump may be provided.

According to an aspect of the disclosure, a clothes treating apparatus capable of controlling a flow path of a circulating airflow passing through a heat exchanger of a heat pump may be provided.

According to an aspect of the disclosure, a clothes treating apparatus capable of converting a flow path to circulate an airflow passing through a heat exchanger of a heat pump inside a cabinet or to circulate the airflow inside another cabinet positioned on the cabinet may be provided.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A clothes treating apparatus comprising:

a cabinet including an air inlet and an air outlet;

a tub inside the cabinet;

a drum rotatable inside the tub; a base partitioning inside of the cabinet to form an air flow path including the air inlet and the air outlet, the base being positioned above the tub;

a heat exchanger on the base;

a supply duct forming a first supply flow path configured to guide air passed through the heat exchanger to the drum and a second supply flow path configured to guide air passed through the heat exchanger to the air outlet;

a discharge duct forming a first discharge flow path configured to guide air passed through the drum to the heat exchanger and a second discharge flow path configured to guide air entered the inside of the cabinet through the air inlet to the heat exchanger;

a first damper configured to be movable between a first position of opening the first supply flow path and closing the second supply flow path and a second position of closing the first supply flow path and opening the second supply flow path; and a second damper configured to be movable between a third position of opening the first discharge flow path and closing the second discharge flow path and a fourth position of closing the first discharge flow path and opening the second discharge flow path.

2. The clothes treating apparatus of claim 1, further comprising:

a first driving motor configured to control a movement of the first damper; and a second driving motor configured to control a movement of the second damper.

3. The clothes treating apparatus of claim 2, wherein:

the first driving motor is configured to move the first damper to the first position or the second position; and the second driving motor is configured to move the second damper to the third position or the fourth position.

4. The clothes treating apparatus of claim 1, wherein based on the first damper being at the first position, the second damper is controlled to be at the third position, and based on the first damper being at the second position, the second damper is controlled to be at the fourth position.

5. The clothes treating apparatus of claim 4, wherein based on the first damper being at the first position and the second damper being at the third position, the supply duct and the discharge duct form a first circulation flow path of guiding air passed through the heat exchanger to the drum and guiding air passed through the drum to the heat exchanger.

6. The clothes treating apparatus of claim 4, wherein based on the first damper being at the second position and the second damper being at the fourth position, the supply duct and the discharge duct form a second circulation flow path of guiding air passed through the heat exchanger to the air outlet and guiding air entered the inside of the cabinet through the air inlet to the heat exchanger.

7. The clothes treating apparatus of claim 1, wherein the supply duct is in a front side of the base, and the discharge duct is in a rear side of the base.

8. The clothes treating apparatus of claim 1, further comprising a fan configured to move air, wherein the base includes a fan accommodating portion configured to accommodate the fan.

9. The clothes treating apparatus of claim 8, wherein the fan accommodating portion is in a front side of the base and connected to the supply duct.

10. The clothes treating apparatus of claim 1, wherein the heat exchanger includes:

an evaporator configured to lower temperature of surrounding air; and a condenser configured to raise temperature of surrounding air.

11. The clothes treating apparatus of claim 10, wherein the base includes a partition wall partitioning the base to form a connecting flow path of guiding air guided by the discharge duct to the supply duct, and the evaporator and the condenser are at one side of the partition wall to be on the connecting flow path.

12. The clothes treating apparatus of claim 11, further comprising a filter configured to filter foreign materials included in air, wherein the filter is at upstream of the evaporator and the condenser on the connecting flow path and configured to filter the foreign materials included in air entering the evaporator and the condenser.

13. The clothes treating apparatus of claim 11, further comprising a compressor on the base, and configured to compress a refrigerant, wherein the compressor is at another side of the partition wall to be outside the connecting flow path.

14. The clothes treating apparatus of claim 1, wherein the cabinet is a first cabinet, the air inlet is a first air inlet, and the air outlet is a first air outlet, the clothes treating apparatus further comprising a second cabinet positioned on the first cabinet, the second cabinet including a second air inlet corresponding to the first air outlet and a second air outlet corresponding to the first air inlet.

15. The clothes treating apparatus of claim 14, wherein, based on inside of the drum of the first cabinet being dried, the first damper is at the first position and the second damper is at the third position, and based on inside of the second cabinet being dried, the first damper is at the second position and the second damper is at the fourth position.

16. The clothes treating apparatus of claim 14, wherein a washing operation of the first cabinet and a drying operation of the second cabinet are performed simultaneously.

* * * * *